United States Patent [19]

Inteso

[11] Patent Number: 4,598,488

[45] Date of Patent: Jul. 8, 1986

[54] EMBROIDERY FRAME

[76] Inventor: Ronald N. Inteso, 6311 De Soto Ave., Unit L, Woodland Hills, Calif. 91367

[21] Appl. No.: 769,439

[22] Filed: Aug. 26, 1985

[51] Int. Cl.[4] ..... D06C 3/08

[52] U.S. Cl. ..... 38/102.3; 112/103; 223/DIG. 2

[58] Field of Search ..... 38/102.3, 102.91, 102.6, 38/102.1, 102.4, 102.5, 102.7, 102.8, 102; 112/103; 223/91, DIG. 2

[56] References Cited

U.S. PATENT DOCUMENTS 218,103 7/1979 Wood ..... 38/102.3

1,118,858 11/1914 Hiegel ..... 38/102.91 X

FOREIGN PATENT DOCUMENTS 273620 7/1927 United Kingdom ..... 223/91

*Primary Examiner*—Werner H. Schroeder

*Assistant Examiner*—Andrew M. Falik

*Attorney, Agent, or Firm*—Rapkin, Gitlin & Moser

[57] ABSTRACT

An embroidery frame or fixture having a generally rectangular shape, side members and front and back members that define the perimeter of the frame, a clamp that extends across the frame having ends that attach to the respective side members and a cross member that extends across the approximate mid-section of the frame having ends that attach to the respective side members. The cross member includes a plurality of vertically oriented teeth that penetrate and grab a portion of the back of the hat to assist in drawing taut the working area on the front portion that is to be embroidered or monogrammed. The clamp and the cross member are slidably adjustable along the length of the frame, but are fixed securely to the side members when the hat is mounted to the frame and in the process of being monogrammed or embroidered. The frame is constructed so as to be easily mountable to the pantograph.

5 Claims, 3 Drawing Figures

EMBROIDERY FRAME

BACKGROUND OF THE INVENTION

1. Field of the Invention

The present invention relates generally to the field of embroidery and monogramming and more particularly to a device used in conjunction with a machine for embroidering and monogramming hats.

2. Description of the Prior Art

With the advent of computer technology has come, among other things, computerized multi-head embroidery and monogramming machines. An embroidery is a decorative design formed with hand or machine needlework. A monogram is a sign of identity, such as the initials of a person's name. Computerized embroidery or monogram machines are used for embroidering and monogramming a variety of items, including shirts, pants, sweaters, handkerchiefs, towels and hats, to name only a few. Conventionally shaped flat surface embroidery racks or frames are adaptable to the machine to embroider or monogram most types of articles. The reason is that most articles can be laid flat and easily drawn taut to allow for a distortion free and high quality monogram or embroidery. Hats, such as baseball type caps, because of their design, exhibit special problems when efforts are made to monogram or embroider them using flat surface framing techniques. The difficulty has been the inability to lay the area to be embroidered or monogrammed flat and maintain it in a taut state. The inability to overcome these obstacles has resulted in the puckering and distortion of the embroidery, a problem normally associated with efforts to flatten a curved shape.

Efforts to resolve the problems have included the use of a specially designed cylindrical or drum shaped hat frame that mounts to the head plate of the bobbin housing and the pantograph, which is an instrument that is situated on the sewing table used to guide the frame during the embroidering or monogramming process consisting of four rigid bars jointed together in parallelogram form. However, there are several problems associated with the use of this frame. For example, the installation of the frame requires the removal of the plastic bobbin housing cover and metal head plate, which in turn requires the time consuming extraction of several screws from the head plate. The cylindrical frame is positioned around the sewing area and the screws are then replaced to secure the frame to the bobbin housing. A guide plate containing a plurality of downwardly extending sprockets is attached to one of the rods of the pantograph. These sprockets correspond to a plurality of perforations or holes that are formed along a portion of the rear edge of the frame. Lateral movement of the pantograph thus causes the cylindrical frame to rotate around the sewing arm during the embroidering or monogramming process.

The hat is mounted over the drum shaped frame with the embroidery work surface and hat bill facing upwards. Clips are used to secure the cap portion and bill to the frame to alleviate all movement of the hat during the embroidering or monogramming process. The set up process is a relatively lengthy one and often takes as long as five minutes or more. Also, the clips are not always successful in securing the hat firmly to the frame. Slight movements of the hat during the monogramming or embroidering process will distort the monogram or embroidery and result in a product of little or no value. The sewing field is also limited to three to six inches due to the length of the rear guide and shape and size of the cylindrical frame. If, during the embroidering or monogramming process, the bobbin jams or something associated with the bobbin or bobbin head malfunctions, the hat must be totally removed to effect repairs. Once the hat is removed, it is almost impossible to realign it to its original location under the sewing head. The result is an obviously distorted embroidery or monogram and second rate product.

Computerized embroidering or monogramming machines come in a variety of sizes, including 2, 6, 12 and 24 head production models. Only the 2 and 6 head models include drop tables located below the sewing head. The 12 and 24 head machines do not contain drop tables, thus precluding the use of these machines with the drum or cylindrical shaped frame, which must be positioned around and mounted to the sewing arm located below the plane of the table.

The present invention solves the many problems associated with the prior art devices, particularly the device described above. Installation of the device of the present invention to the guide rods of the pantograph involves less than 20 seconds of work. Mounting the hat to the frame takes an additional 30 seconds. Using a plurality of clips and other features associated with the device, the embroidery surface is drawn taut against the sewing arm so that it is flat and taut resulting in a distortion free monogram or embroidery. If the bobbin jams or something associated with the bobbin or bobbin housing malfunctions, the operator has unobstructed access to the area to effect repairs without the need to remove the hat from its mount and distort its alignment with the sewing head. Removal of the device takes only about 20 seconds, which is substantially less time than it takes to remove the more complex devices of the prior art.

The advantages and distinctions of the present invention over the prior art will become clearly evident in following disclosure.

SUMMARY OF THE INVENTION

The present invention in its preferred embodiment comprises an embroidery frame or fixture having a generally rectangular shape, side members and front and back members that define the perimeter of the frame, a clamp that extends across the frame having ends that attach to the respective side members and a cross member that extends across the approximate midsection of the frame having ends that attach to the respective side members. The cross member includes a plurality of vertically oriented teeth that penetrate and grab a portion of the back of the hat to assist in drawing taut the working area on the front portion that is too be embroidered or monogrammed. The clamp and the cross member are slidably adjustable along the length of the frame, but are fixed securely to the side members when the hat is mounted to the frame and in the process of being monogrammed or embroidered. The frame is constructed so as to be easily mountable to the pantograph.

The primary object of the present invention is to provide an embroidery frame or fixture that provides for distortion free hat embroidery and monograms.

Another object of the present invention is to provide an embroidery frame or fixture that is easily and quickly mountable to and removable from an embroidery machine.

Another object of the present invention is to provide an embroidery frame or fixtures that is so constructed as to permit a hat to be easily and quickly mounted thereon.

Still another object of the present invention is to provide an embroidery frame or fixture that produces a much higher quality embroidered or monogrammed product than those produced by the prior art devices.

Yet still another object of the present invention is to provide an embroidery frame or fixture that is convenient to use and inexpensive to manufacture.

Other objects and advantages will become apparent in the following specifications when considered in light of the attached drawings wherein a preferred embodiment of the invention is illustrated

A BRIEF DESCRIPTION OF THE DRAWINGS

DETAILED DESCRIPTION OF THE PREFERRED EMBODIMENT

Figures 1, 2:
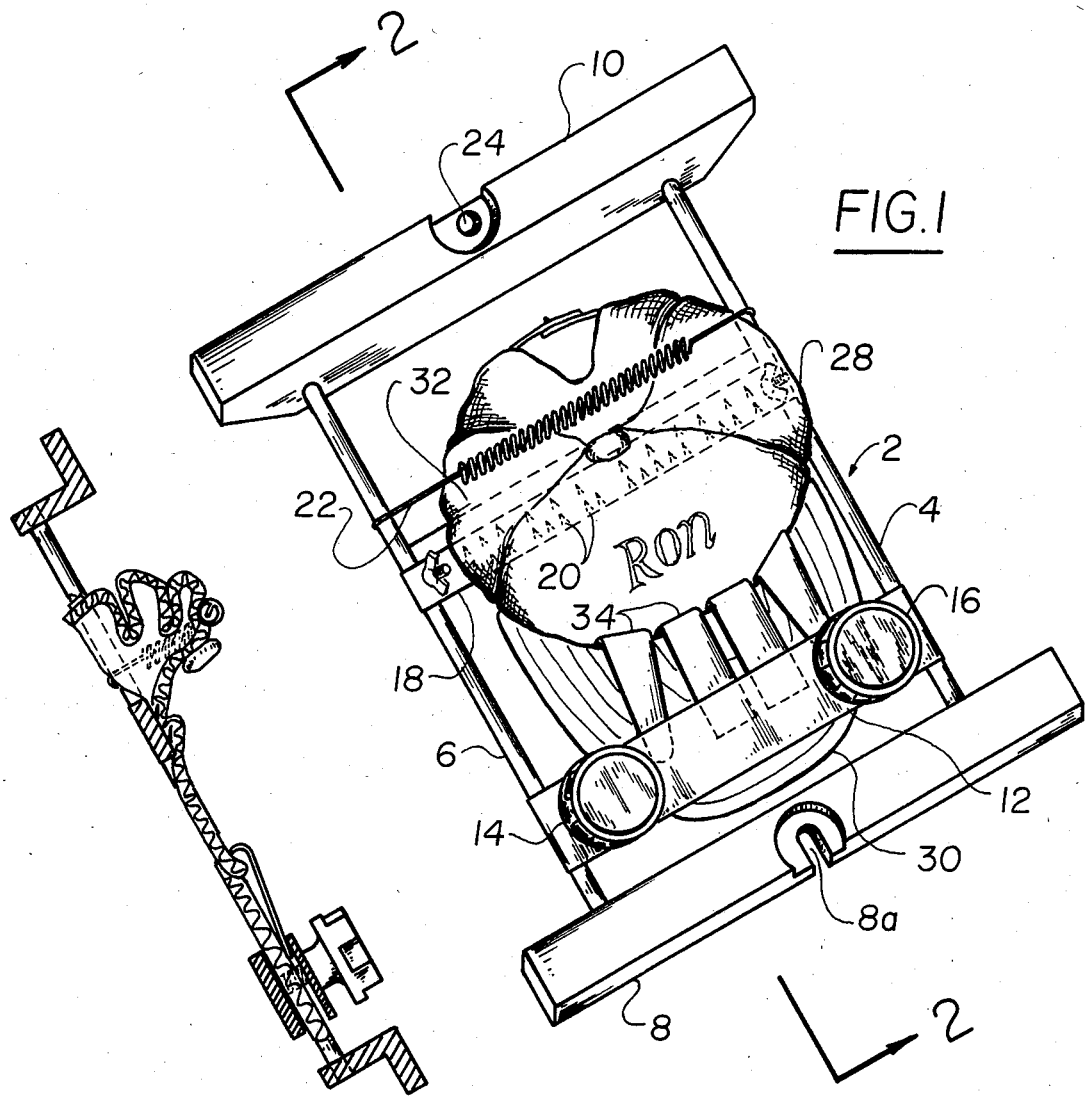
FIG. 1 is a perspective view of the frame of the present invention with a hat mounted thereon.
FIG. 2 is a view of the frame of the present invention shown along line 2—2 of FIG. 1.
Figure 3:
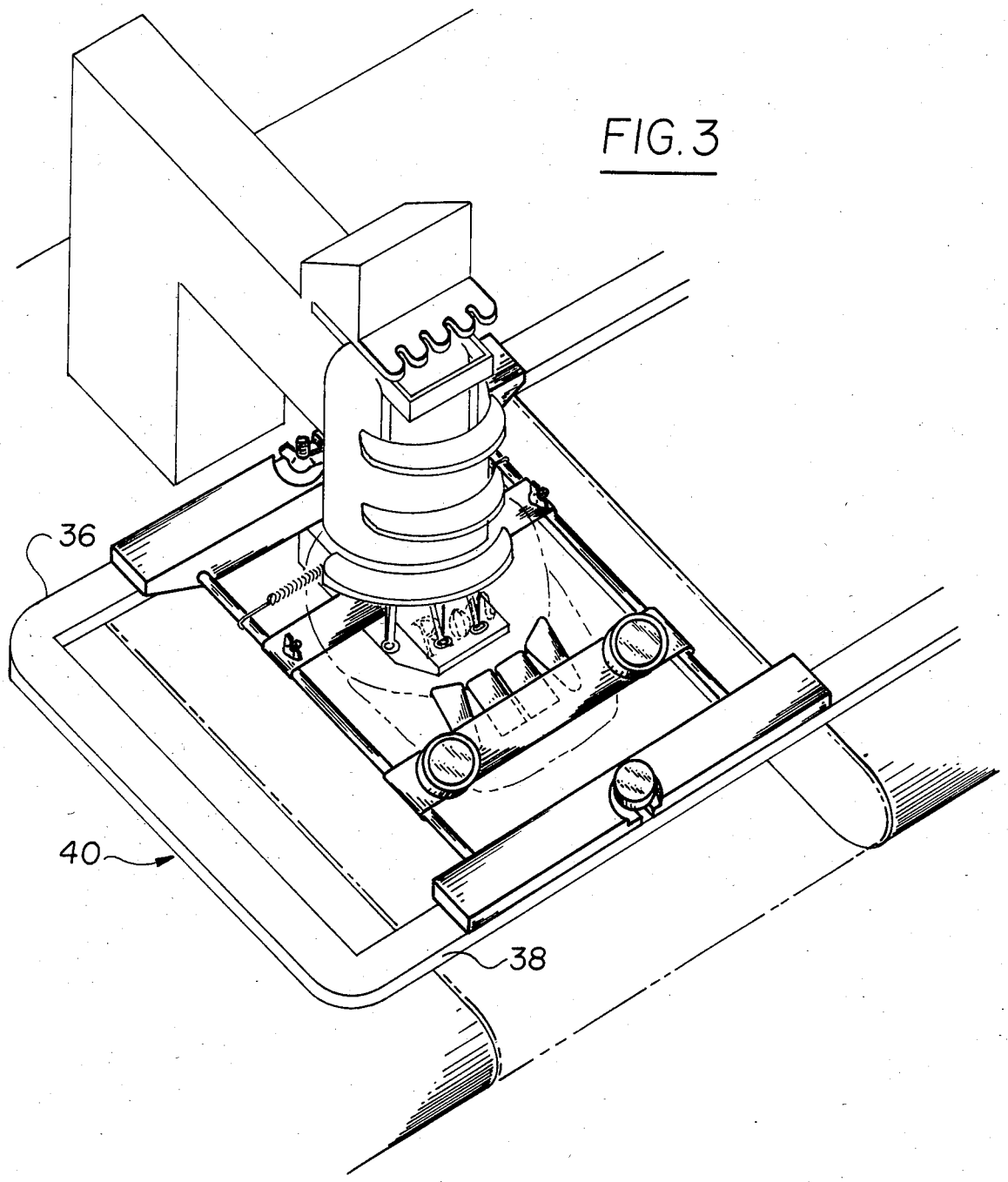
FIG. 3 is a perspective view of the frame of the present invention mounted to the bars of a pantograph of a multi-head embroidery machine.

Referring now in greater detail to the embroidery frame of the present invention, and with particular reference to the embodiment illustrated in the drawing, frame 2 is constructed of any conventional material such as metal alloy or fibreglass and is generally rectangular in shape. Frame 2 is comprised of side members 4 and 6 and front and rear members 8 and 10 joined together in any conventional manner. Clamp 12 is joined at its ends to side members 4 and 6, respectively, and extends across the width of frame 2 generally in close proximity to front member 8. Clamp 12 includes fasteners 14 and 16, which, when turned in a clockwise direction, tighten clamp 12 and, when turned in a counterclockwise direction, loosen clamp 12. Cross member 18 extends across the width of frame 2 at approximately the mid-section thereof and is joined at its ends to side members 4 and 6, respectively. Cross member 18 contains a plurality of generally vertically extending teeth 20 that are disposed along its upper surface. Clamp 12 and cross member 18 are slidably adjustable along the longitudinal axes of side members 4 and 6. Spring 22 attached at its ends to side members 4 and 6, respectively, and extends across the width of frame 2 in close proximity to and in parallel relation with cross member 18. Rear member 10 contains an aperture 24 through which a screw or wing nut may pass to fasten rear member 10 to the rear bar 36 of pantograph 40. Front member 8 contains a slotted aperture **8*a* through which a screw or nut may pass to fasten front member 8 to the front bar 38 of pantograph 40**.

In practice, frame 2 is mounted to pantograph 40 by using an appropriate fastening means, such as a screw or nut, to secure rear member 10 to rear bar 36 and front member 8 to front bar 38. Hat 28 is placed upon frame 2 in the following manner: hat bill 30 is inserted between the top and bottom elements that comprise clamp 12 and is secured firmly by turning clamp fasteners 14 and 16 in a clockwise direction. Hat rear section 32 is then pulled in the direction of rear member 10 and lifted onto teeth 20, which then grab and hold rear section 32 firmly in place. Spring 22 is then positioned over rear section 32 to assist in securing that portion of hat 28 in place. Clips 34, which are generally L-shaped in design, are placed along the front edge of the working area of hat 28. The short leg of each clip 34 is pressed face down against the edge of the working area, while the respective long leg of each clip 34 is inserted between the upper surface of hat bill 30 and the top element of clamp 12. Inserted in this fashion, clips 34 are effective in drawing the working area taut to permit a distortion free and high quality embroidery or monogram.

While the invention will be described in connection with a certain preferred embodiment it is to be understood that it is not intended to limit the invention to that particular embodiment. Rather, it is intended to cover all alternatives, modifications and equivalents as may be included within the spirit and scope of the invention as defined by the appended claims.

I claim:

1. A device for use in conjunction with a machine for embroidering and monogramming hats, which comprises:

a. a frame, said frame being generally rectangular in shape and comprising first and second side members joined at their ends to the corresponding ends of front and back members thereof;

b. a first means to secure the front section of a hat to said frame, said means comprising a clamp, including a top and bottom section, and a plurality of clips each of which has a back end that is placed along and pressed into the front portion of the hat and a front flat end that is inserted under said top section of the clamp to stretch taut the section of said hat to be embroidered or monogrammed; and c. a second means to secure the back section of a hat to said frame, said second means including a cross member having ends that are lockably connected to said first and second side members, respectively, in slideable relationship therewith, said cross member containing a plurality of generally vertically extending teeth disposed along the upper surface thereof for penetrating the fabric and securing the back section of said hat during the process of embroidering or monogramming.

2. The invention of claim 1 wherein the ends of said top section are lockably attached to said first and second side members, respectively, in slidable relation therewith.

3. The invention of claim 1 comprising a further means to secure said back section to said frame.

4. The invention of claim 3, wherein said further means to secure said back section comprises a coiled spring having ends that are hooked to respective said first and second side members.

5. The invention of claim 1 wherein said frame comprises a means at each end thereof to affix said frame to the bars of an embroidery machine pantograph.

* * * * *